US012751599B2

(12) United States Patent
Ahn et al.

(10) Patent No.: US 12,751,599 B2
(45) Date of Patent: Oct. 6, 2026

(54) DISHWASHER

(71) Applicant: LG ELECTRONICS INC., Seoul (KR)

(72) Inventors: Sangsoo Ahn, Seoul (KR); Yongjin Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 66 days.

(21) Appl. No.: 18/728,627

(22) PCT Filed: Dec. 30, 2022

(86) PCT No.: PCT/KR2022/021742

§ 371 (c)(1),
(2) Date: Jul. 12, 2024

(87) PCT Pub. No.: WO2023/136524

PCT Pub. Date: Jul. 20, 2023

(65) Prior Publication Data

US 2025/0134344 A1 May 1, 2025

(30) Foreign Application Priority Data

Jan. 13, 2022 (KR) ..... 10-2022-0005383

(51) Int. Cl.
*A47L 15/50* (2006.01)

(52) U.S. Cl.
CPC ..... *A47L 15/503* (2013.01); *A47L 15/502* (2013.01)

(58) Field of Classification Search
CPC .... A47L 15/205; A47L 15/503; A47L 15/502; A47L 15/50
See application file for complete search history.

(56) References Cited

U.S. PATENT DOCUMENTS 8,646,620 B2 2/2014 Klump et al.
10,602,910 B2 * 3/2020 Gutkowski ..... A47L 15/506
(Continued)

FOREIGN PATENT DOCUMENTS

CN 204950862 U 1/2016
EP 2 272 416 A2 1/2011
(Continued)

*Primary Examiner* — Kimberley S Wright
(74) *Attorney, Agent, or Firm* — Birch, Stewart, Kolasch & Birch, LLP

(57) ABSTRACT

The present disclosure relates to a dishwasher. The dishwasher, according to one aspect of the present disclosure, comprises: a cabinet having an opening formed in the front thereof; a tub disposed inside the cabinet; and a rack disposed so as to be withdrawable to the front through the opening from inside the tub. The rack comprises: a basket in which objects to be washed are seated; and a holding apparatus disposed on the upper side of the basket. The holding apparatus comprises: a base bar connected to the basket and extending in the direction intersecting with the front-rear direction; a plurality of support bars extending upward from the base bar so as to be spaced from each other along the extending direction of the base bar; and a gap opened in the front-rear direction between the plurality of support bars. Thus, tableware such as a knife may be easily accommodated.

9 Claims, 10 Drawing Sheets

(56) References Cited

U.S. PATENT DOCUMENTS

| | | | | |
|---|---|---|---|---|
| 11,642,002 | B1 * | 5/2023 | Tanpure | A47L 15/503 211/41.8 |
| 11,751,750 | B2 * | 9/2023 | Kim | A47L 15/504 211/41.8 |
| 2014/0174486 | A1 | 6/2014 | Fey et al. | |
| 2015/0196189 | A1 * | 7/2015 | Shaffer | A47L 15/502 312/228.1 |
| 2015/0320290 | A1 * | 11/2015 | Hederstierna | A47L 15/505 211/41.9 |
| 2015/0327749 | A1 | 11/2015 | Kåberg et al. | |
| 2018/0206700 | A1 * | 7/2018 | Ko | A47L 15/506 |
| 2020/0046199 | A1 * | 2/2020 | Büsing | A47L 15/507 |
| 2023/0138170 | A1 * | 5/2023 | Ko | A47L 15/503 312/228.1 |
| 2023/0148039 | A1 * | 5/2023 | Ko | A47L 15/504 211/41.8 |
| 2024/0349978 | A1 * | 10/2024 | Lee | A47L 15/503 |

FOREIGN PATENT DOCUMENTS

| | | | |
|---|---|---|---|
| KR | 1999-0075791 | A | 10/1999 |
| KR | 10-1054206 | B1 | 8/2011 |
| KR | 10-1290375 | B1 | 7/2013 |
| WO | WO 00/49935 | A1 | 8/2000 |

* cited by examiner

DISHWASHER

CROSS REFERENCE TO RELATED APPLICATIONS

This application is the National Phase of PCT International Application No. PCT/KR2022/021742, filed on Dec. 30, 2022, which claims priority under 35 U.S.C. 119 (a) to Patent Application No. 10-2022-0005383, filed in the Republic of Korea on Jan. 13, 2022, all of which are hereby expressly incorporated by reference into the present application.

TECHNICAL FIELD

The present disclosure relates to a dishwasher, and more specifically, to a rack disposed inside a tub.

BACKGROUND ART

A dishwasher is a machine that sprays washing water and steam on tableware placed inside a tub to keep the tableware clean and sanitary.

A rack for storing tableware is disposed inside the tub, and a plurality of racks are arranged to be spaced apart from each other in a vertical direction.

However, a conventional dishwasher is problematic in that tableware is stored while lying down to avoid interference between the tableware and the tub when storing the tableware on the uppermost rack, so the washing efficiency of the tableware is reduced and the space utilization of the rack is decreased.

Further, when tableware is stored upright to improve the washing efficiency of the tableware, there is a problem that interference occurs between the tableware and a wall of the tub and interference occurs between different types of tableware, causing damage to the tableware.

DETAILED DESCRIPTION OF INVENTION

Technical Problems

The present disclosure is to solve the above and other problems.

According to one embodiment of the present disclosure, the present disclosure is to facilitate the storage of tableware.

According to one embodiment of the present disclosure, the present disclosure is to increase space utilization for tableware storage.

According to one embodiment of the present disclosure, the present disclosure is to improve the washing efficiency of tableware stored in a rack.

According to one embodiment of the present disclosure, the present disclosure is to avoid interference between tableware and a tub.

According to one embodiment of the present disclosure, the present disclosure is to avoid interference between various types of tableware stored in a rack.

According to one embodiment of the present disclosure, the present disclosure is to prevent damage to tableware.

Technical objects to be achieved by the present disclosure are not limited to those described above, and other technical objects not mentioned above may also be clearly understood from the descriptions given below by those skilled in the art to which the present disclosure belongs.

Technical Solution

Among embodiments, a dishwasher according to an aspect of the present disclosure may include a cabinet having on a front thereof an opening, a tub disposed inside the cabinet, and a rack disposed to be withdrawable forwards through the opening from an inside of the tub.

The rack may include a basket in which an object to be washed is seated.

The rack may include a holding apparatus disposed on an upper side of the basket.

The holding apparatus may include a base bar connected to the basket and extending in a direction intersecting a front-rear direction.

The holding apparatus may include a plurality of support bars extending upward from the base bar and spaced apart from each other along an extending direction of the base bar.

The holding apparatus may include a gap opened in the front-rear direction between the plurality of support bars.

A plurality of holding apparatuses may be arranged to be spaced apart from each other in the front-rear direction.

The plurality of holding apparatuses may be aligned to correspond to the gap in the front-rear direction.

The rack may include a second holding apparatus disposed above the basket and extending in a direction intersecting the base bar.

The rack may include a fixed storage part spaced apart from the basket.

The rack may include a partition wall disposed between the basket and the fixed storage part.

The holding apparatus may be disposed between the second holding apparatus and the partition wall.

The holding apparatus and the second holding apparatus may be located lower than the partition wall.

The rack may include a pair of third holding apparatuses disposed above the fixed storage part, extending in a direction intersecting the base bar, and spaced apart from each other in the extending direction of the base bar.

A gap between the holding apparatus and the partition wall may be smaller than a gap between the third holding apparatus and the partition wall.

The basket may include a plurality of wires extending in the front-rear direction and in a direction intersecting the front-rear direction.

The basket may include a pair of first protrusion parts protruding upwards from the wires and spaced apart from each other in the extending direction of the base bar.

The basket may include a plurality of second protrusion parts disposed between the pair of first protrusion parts and spaced apart from each other in the extending direction of the base bar.

The base bar may be rotatably disposed between the pair of first protrusion parts.

The basket may include an apparatus insert part formed under the first protrusion part and the second protrusion part and opened downwards.

The support bar may include a fixing projection projecting in the extending direction of the base bar.

The first protrusion part may include a holder which is recessed in the extending direction of the base bar and into which the fixing projection is inserted.

The tub may include an upper wall provided above the rack to be spaced apart therefrom.

The holding apparatus may support a knife having a knife blade located in the gap.

The upper wall may define a vertical gap from a handle of the knife held on the holding apparatus.

Specific details of other embodiments are included in the detailed description and drawings.

Effect of Invention

According to at least one of embodiments of the present disclosure, it is possible to facilitate the storage of tableware by holding a knife in a holding apparatus.

According to at least one of embodiments of the present disclosure, it is possible to improve the space utilization of a rack by storing a knife upright in a rack.

According to at least one of embodiments of the present disclosure, it is possible to effectively wash both sides of a knife by storing a knife upright in a rack.

According to at least one of embodiments of the present disclosure, it is possible to prevent interference between a knife and another tableware by holding a knife upright in a holding apparatus.

According to at least one of embodiments of the present disclosure, it is possible to prevent interference between a sidewall of a tub and a knife by storing the knife upright in a front-rear direction.

Effects of the present disclosure are not limited to the above-mentioned effects, and other effects which are not mentioned will be clearly understood by those skilled in the art from the following claims.

BEST MODE FOR CARRYING OUT THE INVENTION

Figure 1:
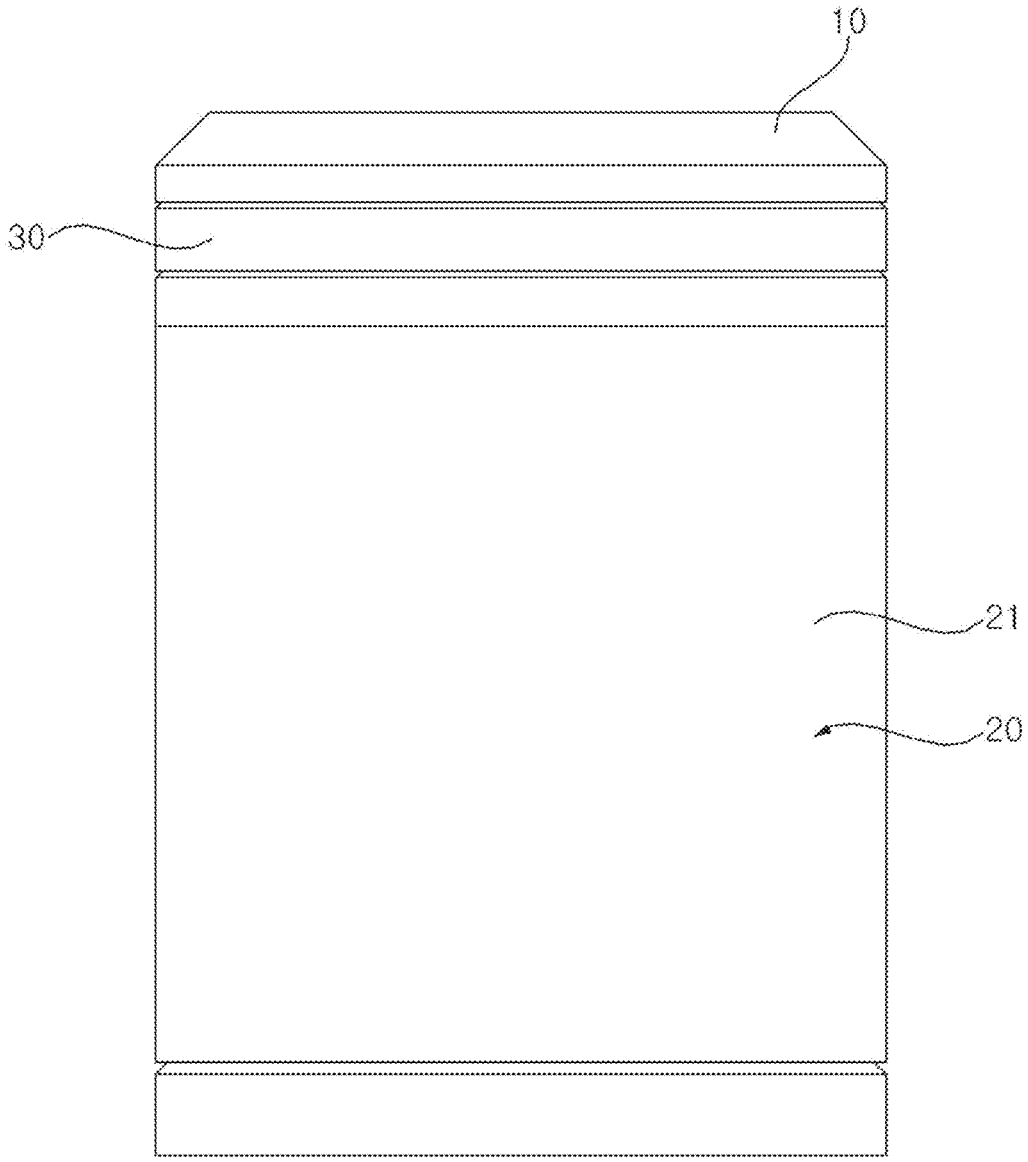
FIG. 1 is a front view illustrating a dishwasher according to an aspect of the present disclosure.

Hereinafter, preferred embodiments of the present disclosure will be described in detail with reference to the accompanying drawings. The same reference numerals are used throughout the drawings to designate the same or similar components, and a duplicated description thereof will be omitted.

The words "module" and "part" for components used in the following description are given or used interchangeably only for the ease of preparing the specification, and do not have distinct meanings or roles in themselves.

In the following description, if it is decided that the detailed description of known technologies related to the present disclosure makes the subject matter of the embodiments described herein unclear, the detailed description is omitted. Further, the accompanying drawings are provided only for easy understanding of embodiments disclosed in the specification, and the technical spirit disclosed in the specification is not limited by the accompanying drawings, and all changes, equivalents, and replacements should be understood as being included in the spirit and scope of the present disclosure.

It will be understood that, although the terms "first", "second", etc. may be used herein to describe various components, these components should not be limited by these terms. These terms are only used to distinguish one component from another component.

It will be understood that when a component is referred to as being "coupled" or "connected" to another component, it can be directly coupled or connected to the other component or intervening components may be present therebetween. In contrast, it should be understood that when a component is referred to as being "directly coupled" or "directly connected" to another component, there are no intervening components present.

In the present disclosure, the singular forms are intended to include the plural forms as well, unless the context clearly indicates otherwise.

Referring to FIG. 1, the entire appearance of a dishwasher 1 will be described.

The dishwasher 1 may include a cabinet 10 in which a tub 100 (see FIG. 2) accommodating an object to be washed is disposed, and a door 20 disposed on a front of the cabinet 10.

The cabinet 10 may define the appearance of the dishwasher 1 and may have the shape of a square pillar. The front of the cabinet 10 may be opened, and an object to be washed may be introduced into the tub 100 through the opening of the cabinet 10.

The door 20 may open or close the opening of the cabinet 10. The door 20 may close the opening to seal the tub 100, and may open the opening to cause the tub 100 to communicate with the outside of the cabinet 10.

The dishwasher 1 may include a control panel 30 disposed on an upper side of the door 20. The control panel 30 may a display that may display the driving information of the dishwasher 1 and select the operating course of the dishwasher 1. The control panel 30 may be connected to the door 20 to form the front of the door 20. The control panel 30 may be connected to a door body 21 to be moved forwards together with the door body 21. The control panel 30 may be moved forwards to open the opening of the cabinet 10.

Figure 2:
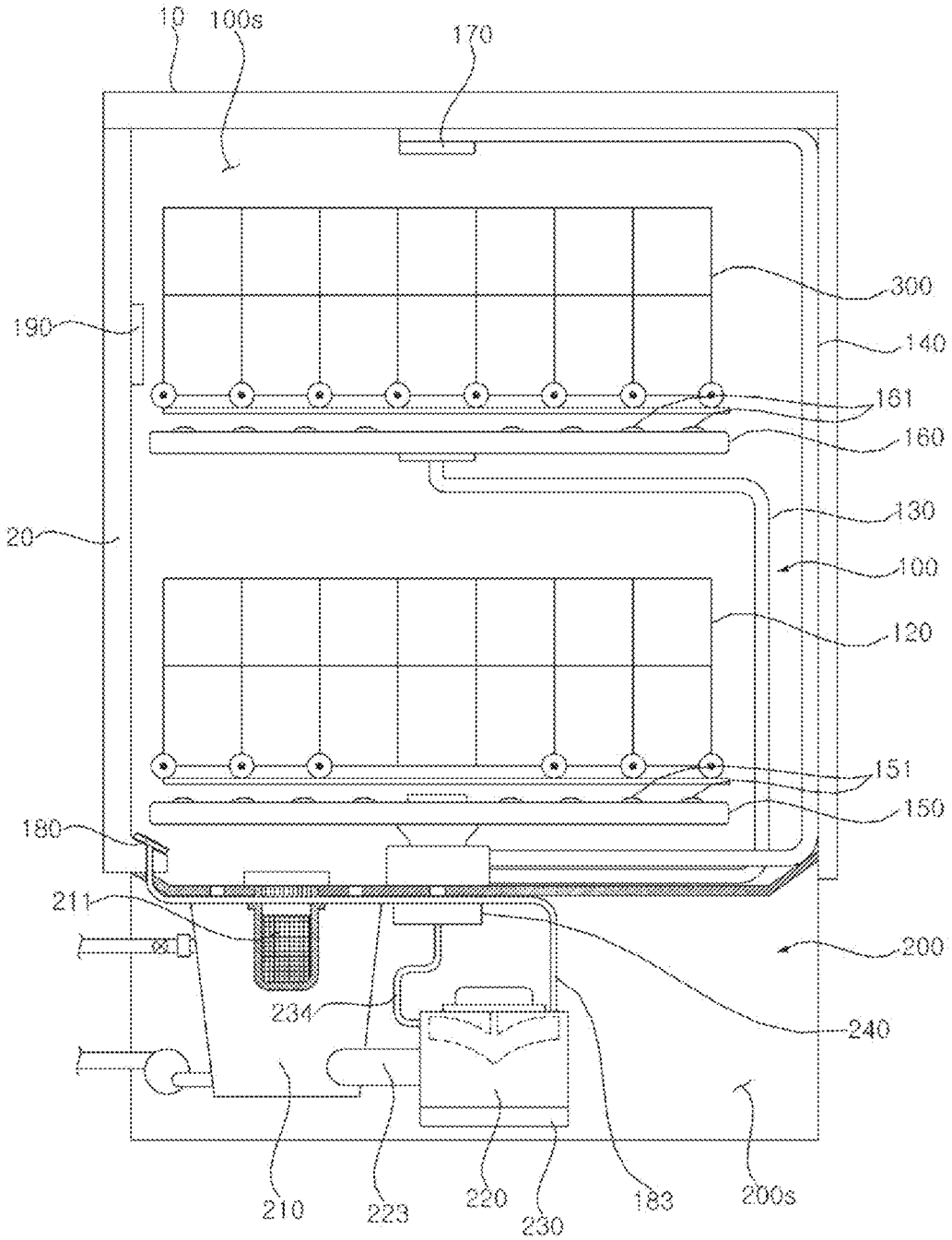
FIG. 2 is a diagram illustrating the internal structure of the dishwasher according to an aspect of the present disclosure.

Hereinafter, the internal structure of the dishwasher 1 will be described with reference to FIG. 2.

The tub 100 accommodates an object to be washed. Washing water is sprayed into the tub 100. The tub 100 is disposed in the cabinet 10, and defines a washing space 100S in which the object to be washed is accommodated.

A driving part 200 is disposed under the tub 100 to circulate the washing water.

The driving part 200 may be disposed in the cabinet 10. The driving part 200 defines a driving space 200S in which structures for circulating the washing water, which will be described later, are disposed.

The dishwasher includes racks 300 and 120 disposed in the tub 100. The racks 300 and 120 may include an upper rack 300 and a lower rack 120 disposed under the upper rack 110.

A plurality of spray tubes 150, 160, and 170 may be disposed in the tub 100 to spray the washing water toward the washing objects seated on the upper rack 300 and the lower rack 120.

The plurality of spray tubes 150, 160, and 170 may include a lower spray tube 150 disposed under the lower rack 120, an upper spray tube 160 disposed between the upper rack 300 and the lower rack 120, and a top spray tube 170 disposed above the upper rack 300.

Each of the plurality of spray tubes 150, 160, and 170 may be supplied with the washing water from a washing pump 220. A first spray pipe 130 and a second spray pipe 140 extending from the driving part 200 may be disposed in the tub 100.

The first spray pipe 130 may extend upwards from the switching valve 240 and extend toward the upper spray tube 160.

The second spray pipe 140 may extend upwards from the switching valve 240 and extend toward the top spray tube 170.

The upper spray tube 160 may be connected to the first spray pipe 130 to be supplied with the washing water through the first spray pipe 130. The top spray tube 170 may be connected to the second spray pipe 140 to be supplied with the washing water through the second spray pipe 140.

The lower spray tube 150 may be connected to the switching valve 240 to be supplied with the washing water through the switching valve 240.

The lower spray tube 150 may include a plurality of lower injection nozzles 151. The lower injection nozzle 151 may be opened toward the washing space 100*s*, and spray the washing water toward the lower rack 120.

The upper spray tube 160 may include a plurality of upper injection nozzles 161. The upper injection nozzle 161 may be opened toward the washing space 100*s*.

The top spray tube 170 may be rotatably disposed on the upper side of the tub 100, and may spray washing water toward the inside of the tub 100.

A steam injection nozzle 180 is disposed in the tub 100 to supply steam to the inside of the tub 100. The steam injection nozzle 180 may be disposed on the front of the tub 100 adjacent to the door 20. The steam injection nozzle 180 may be disposed to face the lower rack 120.

The steam injection nozzle 180 may be connected to the washing pump 220 of the driving part 200 to be supplied with steam produced by the washing pump 220.

The driving part 200 may include a sump 210 in which washing water sprayed toward the washing space 100S is collected, a washing pump 220 extruding the washing water collected in the sump 210 toward the tub 100, a heater 230 connected to the washing pump 220 to heat the washing water flowing in the washing pump 220, and a switching valve 240 distributing washing water extruded from the washing pump 220.

The sump 210 may include a filter 211 that filters out foreign substances contained in the collected washing water.

The washing pump 220 may be connected to the sump 210 through a pump introduction pipe 223. When the washing pump 220 is operated, the washing water collected in the sump 210 may flow into the washing pump 220 through the pump introduction pipe 223.

The heater 230 may heat the washing water introduced into the washing pump 220 to produce hot water or steam. The heater 230 may be disposed below the washing pump 220 and may be manufactured integrally with the washing pump 220.

Hot washing water heated in the washing pump 220 may flow into the switching valve 240 through a pump discharge pipe 234. The washing water flowing into the switching valve 240 may be distributed to a spray arm 150, a first distribution pipe 130, and a second distribution pipe 140. The switching valve 240 may selectively circulate the introduced washing water to any one of the spray arm 150, the first distribution pipe 130, and the second distribution pipe 140.

Washing water in a steam state heated in the washing pump 220 may flow to a steam nozzle 180 through a steam nozzle inlet pipe 183. The steam nozzle 180 may be connected to the washing pump 220 through the steam nozzle inlet pipe 183 to be supplied with steam from the washing pump 220.

A detergent supply device 190 may be disposed in the washing space 100*s* to supply detergent to the inside of the tub 100. The detergent supply device 190 may be coupled to the door 20.

Figure 3:
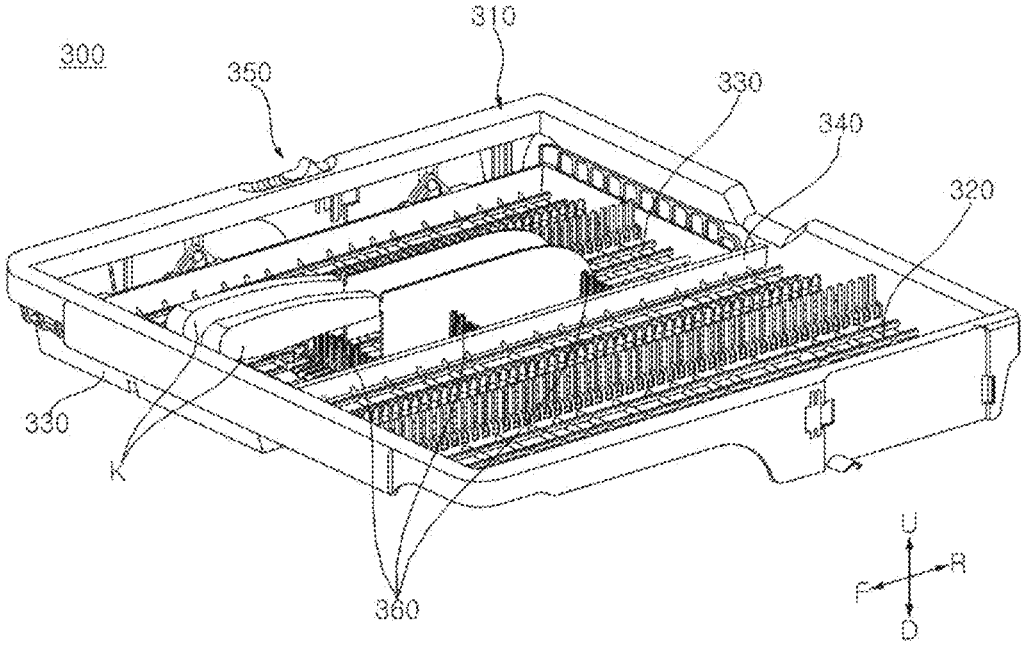
FIG. 3 is a perspective view illustrating a rack according to an aspect of the present disclosure.

Hereinafter, the rack 300 will be described with reference to FIG. 3.

The rack 300 may include a frame 310, a fixed storage part 320 disposed in the frame 310, a basket 330 disposed in the frame 310 to be spaced apart from the fixed storage part 320, a partition wall 340 disposed between the fixed storage part 320 and the basket 330, a lifting device 350 moving the basket 330 up and down, and a holding apparatus 360 disposed on an upper side of the basket 330.

The frame 310 may have the shape of a rectangular closed loop. The frame 310 may define a space in which tableware is accommodated.

The fixed storage part 320 may be secured to the inside of the frame 310. The fixed storage part 320 may be secured to the frame 310.

The basket 330 may be disposed inside the frame 310 to be movable up and down. The basket 330 may be connected to the frame 310 to be movable up and down. The basket 330 may be moved downwards with respect to the frame 310 and be positioned lower than the fixed storage part 320.

The partition wall 340 may partition the fixed storage part 320 and the basket 330. The partition wall 340 may be connected to the frame 310 and the fixed storage part 320.

The lifting device 350 may be disposed on the frame 310. The lifting device 350 may connect the frame 310 and the basket 330. Known technology may be equally applied to a structure in which the lifting device 350 raises and lowers the basket 330.

The holding apparatus 360 may be disposed in the upper side of the basket 330. The holding apparatus 360 may support a knife K accommodated in the rack 300. A knife blade of the knife K may be disposed in the holding apparatus 360 and stored in the rack 300 with the blade upright.

A plurality of holding apparatuses 360 may be arranged. The knives K may be supported by the plurality of holding apparatuses 360. Some of the plurality of holding apparatuses 360 may support knife blades. The remainder of the plurality of holding apparatuses 360 may support handles of the knives K. The blade of the knife K may be disposed in a gap 363 that will be described later. The handle of the knife K may be seated on the upper side of the holding apparatus 360.

Figure 4:
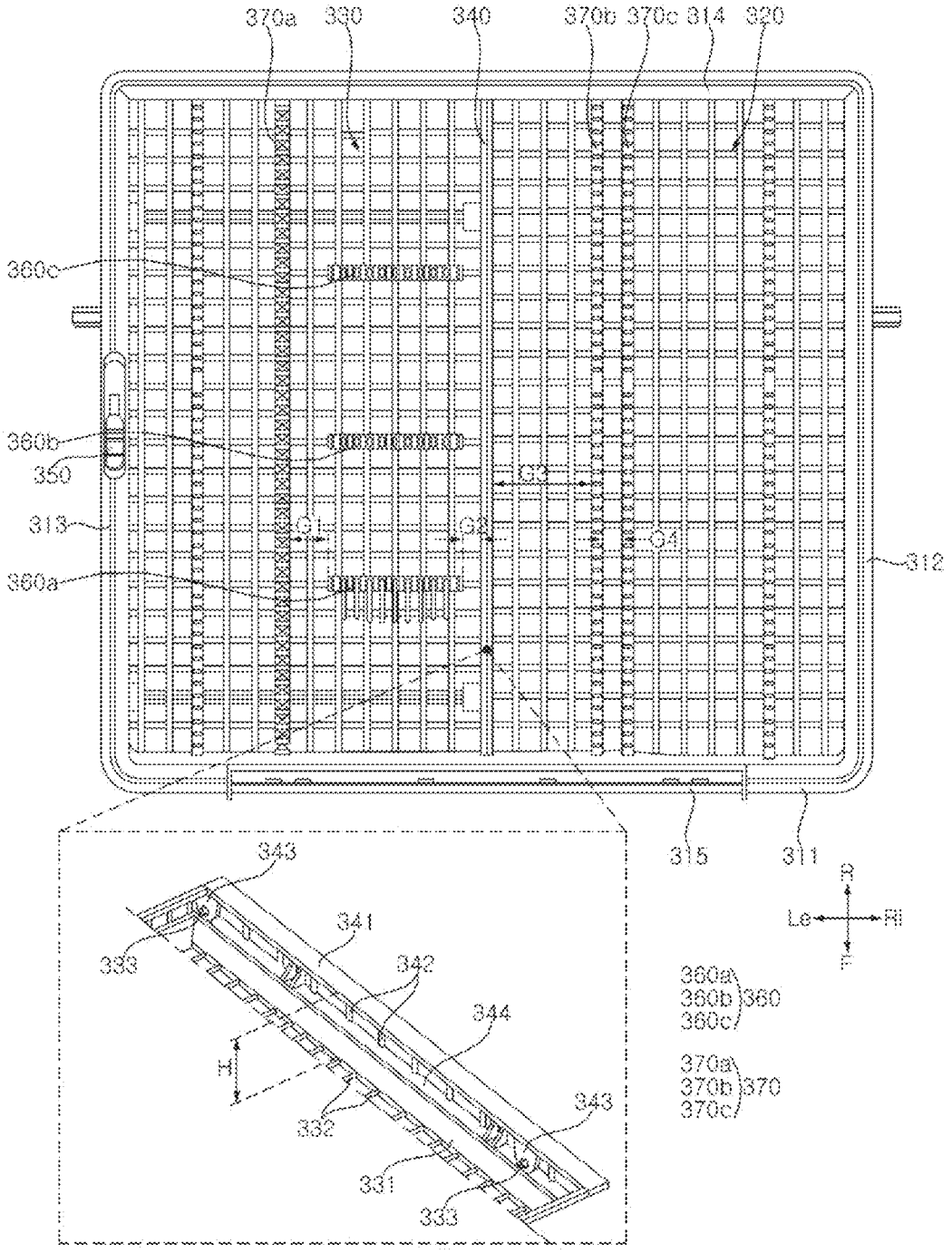
FIG. 4 is an upward perspective view illustrating the rack according to an aspect of the present disclosure.
Figure 5:
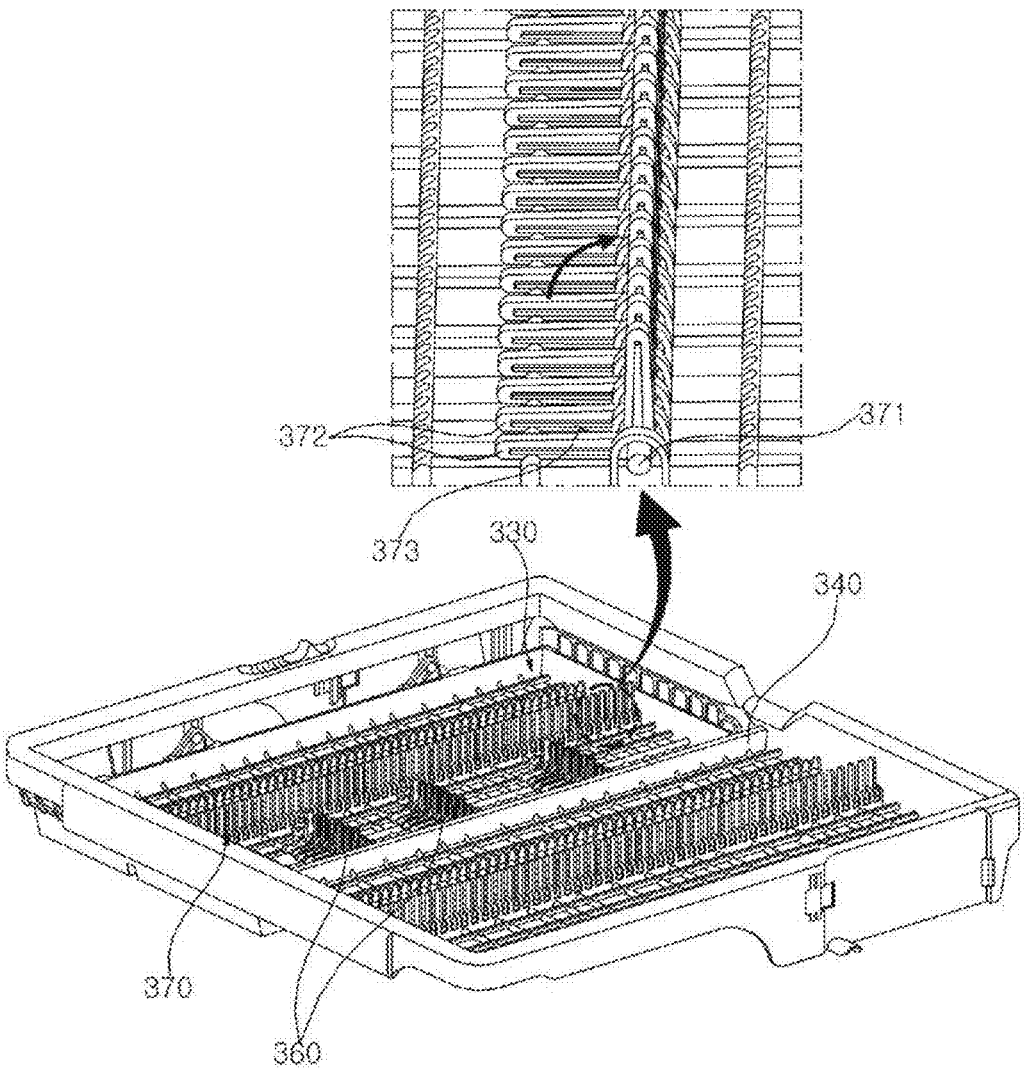
FIG. 5 is a perspective view illustrating the rack according to an aspect of the present disclosure.

Hereinafter, the holding apparatuses 360 and 370 of the rack 300 will be described with reference to FIGS. 4 and 5.

The rack 300 may include a plurality of holding apparatuses 360 and 370. The holding apparatuses 360 and 370 may include a first holding apparatus 360 extending in a left-right direction, a second holding apparatus 370*a* extending in a front-rear direction, and third holding apparatuses 370*b* and 370*c* extending in the front-rear direction. The first holding apparatus 360 and the second holding apparatus 370*a* may extend in directions that intersect each other. The first holding apparatus 360 and the third holding apparatuses 370*b* and 370*c* may extend in directions that intersect each other.

A plurality of first holding apparatuses 360 (hereinafter referred to as the "holding apparatus") may be arranged to be spaced apart from each other in the front-rear direction. The holding apparatus 360 may include a front holding apparatus 360*a*, an intermediate holding apparatus 360*b*, and a rear holding apparatus 360*c*. The front holding apparatus 360*a*, the intermediate holding apparatus 360*b*, and the rear holding apparatus 360*c* may be arranged in the front-rear direction. The intermediate holding apparatus 360*b* and the rear holding apparatus 360*c* may support the knife blade, and the front holding apparatus 360*a* may support the handle of the knife. A gap 363 (see FIG. 6) of each holding apparatus 360*a*, 360*b*, or 360*c* may correspond in the front-rear direction.

The second holding apparatus 370*a* may be disposed on the upper side of the basket 330. The second holding apparatus 370*a* may be spaced apart from the first holding apparatus 360. The second holding apparatus 370*a* may face each of the plurality of first holding apparatuses 360*a*, 360*b*, and 360*c*.

The first holding apparatus 360 may be disposed between the second holding apparatus 370*a* and the partition wall 340. The first holding apparatus 360 may be spaced apart from each of the second holding apparatus 370*a* and the partition wall 340.

The third holding apparatuses 370*b* and 370*c* may be disposed on the upper side of the fixed storage part 320. The partition wall 340 may be disposed between the first holding apparatus 360 and the third holding apparatuses 370*b* and 370*c*.

The third holding apparatuses 370*b* and 370*c* may be formed in pairs. The third holding apparatuses 370*b* and 370*c* may include a 3-1 holding apparatus 370*b* and a 3-2 holding apparatus 370*c*.

The 3-1 holding apparatus 370*b* and the 3-2 holding apparatus 370*c* may extend parallel to each other. The 3-1 holding apparatus 370*b* and the 3-2 holding apparatus 370*c* may be spaced apart from each other in the left-right direction. The third holding apparatuses 370*b* and 370*c* may support tableware such as spoons, forks, and chopsticks.

A gap G2 between the first holding apparatus 360 and the partition wall 340 may be smaller than a gap G3 between the third holding apparatuses 370*b* and 370*c* and the partition wall 340.

The gap G2 between the first holding apparatus 360 and the partition wall 340 may be smaller than a gap G1 between the first holding apparatus 360 and the second holding apparatus 370*a*.

The gap G3 between the third holding apparatuses 370*b* and 370*c* and the partition wall 340 may be larger than a gap G4 between the 3-1 holding apparatus 370*b* and the 3-2 holding apparatus 370*c*.

The frame 310 may include a front frame 311, a first side frame 312 extending rearwards from the front frame 311, a second side frame 313 extending rearwards from the front frame 311 and facing the first side frame 312, and a rear frame 314 connecting the first side frame 312 and the second side frame 313 and facing the front frame 311.

The front frame 311 may be disposed in front of the holding apparatus 360. The front frame 311 may include a handle 315 that provides a gripping space.

The lifting device 350 may be disposed on the side frame 313. A user may drive the lifting device 350 disposed on the side frame 313 to move the basket 330 up and down.

The fixed storage part 320 may be disposed between the first side frame 312 and the partition wall 340. The basket 330 may be disposed between the second side frame 313 and the partition wall 340.

The partition wall 340 may be positioned above the basket 330. When the basket 330 is moved downwards by the lifting device 350, the partition wall 340 may be located above the basket 330.

The partition wall 340 may include a first partition-wall frame 341 connected to the fixed storage part 320, a bridge 342 extending downwards from the first partition-wall frame 341, a second partition-wall frame 344 disposed under the first partition-wall frame 341 and connected to the bridge 342, and a link 343 rotatably connected to the basket 330.

The basket 330 may include a basket frame 331 moved up and down, a wire 332 disposed inside the basket frame 331, and a joint 333 rotatably connected to the link 343.

When the basket 330 is moved downwards by driving the lifting device 350, the link 343 and the joint 333 may be rotated.

When the basket 330 is moved downwards, the basket 330 may form a height difference H with the partition wall 340. The height difference H may refer to a gap between the first partition-wall frame 341 and the wire 332. The height difference H may refer to a vertical gap between the basket 330 and the fixed storage part 320.

When the basket 330 is moved downwards and the tableware is held on the second holding apparatus 370*a*, the tableware held on the second holding apparatus 370*a* may be locked on the partition wall 340 due to the height difference H between the basket 330 and the fixed storage part 320. Thus, the rack 300 of the present disclosure may be provided with the holding apparatus 360 extending in the left-right direction and hold long tableware on the holding apparatus 360, thereby avoiding interference between the tableware and the partition wall 340.

The second holding apparatus 370*a* may include a second base bar 371 extending in the front-rear direction, a plurality of second support bars 372 extending upwards from the second base bar 371, and a gap 373 formed between the plurality of second support bars 372.

The second base bar 371 may be rotatably connected to the basket 330. The second base bar 371 may rotate around a rotating axis extending in the front-rear direction.

The second support bar 372 may support tableware passing through the gap 373. The plurality of second support bars 372 may be spaced apart from each other in the front-rear direction. The second support bar 372 may be erected or laid down by the rotation of the base bar 371. Thus, when the tableware is not held on the second holding apparatus 370*a*, the second support bar 372 may be laid down by rotating the second base bar 371.

When relatively long tableware is held on the second holding apparatus 370*a*, a problem may occur where the tableware interferes with the partition wall 340 or sidewalls 102 and 103 (see FIG. 10) of the tub 100. Thus, a spoon, a fork or the like that is relatively short in length may be held on the second holding apparatus 370*a*. On the other hand, since the first holding apparatus 360 does not cause an interference problem with the tableware even if relatively long tableware is held thereon, a relatively long knife K may be held on the first holding apparatus 360.

Figure 6:
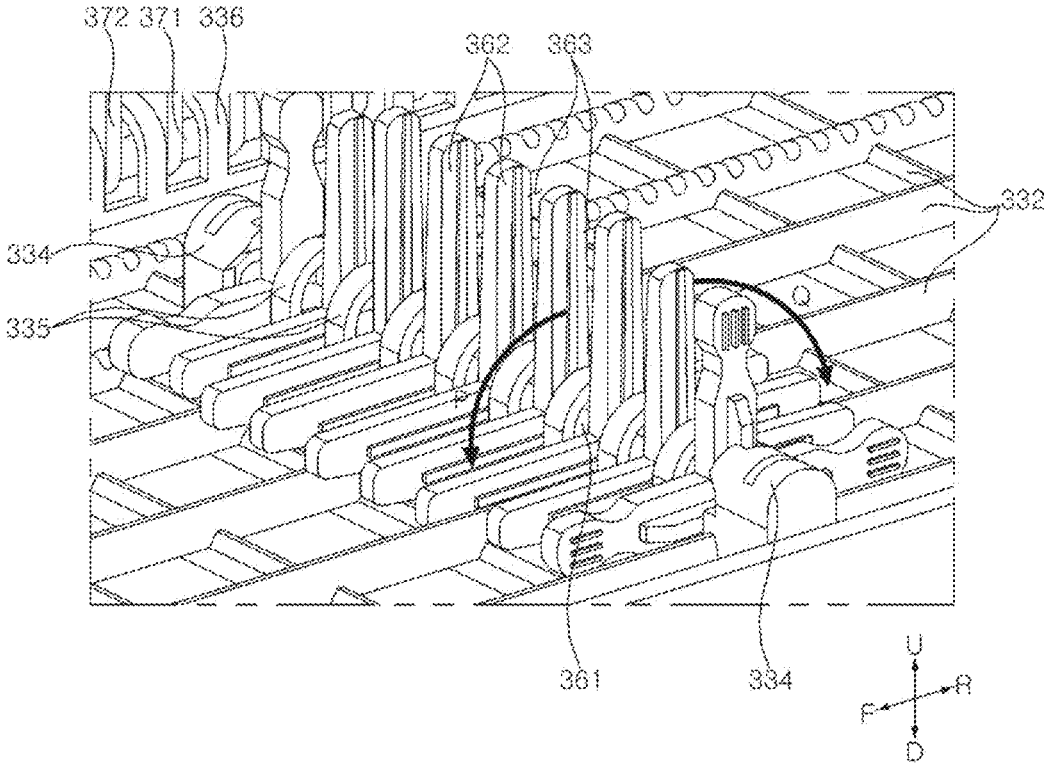
FIG. 6 is an enlarged view illustrating a holding apparatus according to an aspect of the present disclosure.

Hereinafter, the holding apparatus 360 will be described with reference to FIG. 6.

The holding apparatus 360 may be rotatably connected to the basket 330.

The holding apparatus 360 may include a base bar 361 extending in a direction that intersects the front-rear direction, a plurality of support bars 362 extending upwards from the base 361, and a gap 363 formed between the plurality of support bars 362.

The holding apparatus 360 may be rotated around the base bar 361 as a rotating axis. The holding apparatus 360 may be rotated in a first direction P toward a front based on the base bar 361, and be rotated in a second direction Q toward a rear based on the base bar 361. The holding apparatus 360 may be rotated in both directions based on the base bar 361.

The basket 330 may include wires 332 extending in the front-rear direction and in the direction intersecting the front-rear direction, a pair of first protrusion parts 334 extending upwards from the wires 332 and spaced apart from each other in the extending direction of the base bar 361, and a plurality of second protrusion parts 335 disposed between the pair of first protrusion parts 334 and spaced apart from each other in the extending direction of the base bar 361.

The first protrusion part 334 and the second protrusion part 335 may be secured to the wire 332. The first protrusion part 334 and the second protrusion part 335 may be integrated with the wire 332.

The base bar 361 may extend between the pair of first protrusion parts 334. The plurality of second protrusion parts 335 may provide a hole through which the base bar 361 passes. The base bar 361 may pass through the plurality of second protrusion parts 335 between the pair of first protrusion parts 334.

The base bar 361 may be rotated between the pair of first protrusion parts 334. The base bar 361 may be rotated inside the plurality of second protrusion parts 335.

When the support bar 362 is in an upright state, the gap 363 may be opened in the front-rear direction. A plurality of gaps 363 may be formed in the extending direction of the base bar 361. A user may pass the knife blade through the gap 363, and the support bar 362 may support the knife blade within the gap 363. Further, the user may place the handle of the knife on the upper side of the support bar 362, and the support bar 362 may support the handle of the knife. For instance, as shown in FIG. 3, the support bar 362 may support the handle of the knife in the case of the front holding apparatus 360*a*, and the support bar 362 may support the knife blade in the case of the intermediate holding apparatus 360*b* and the rear holding apparatus 360*c*.

When the base bar 361 is rotated in a first direction P or in a second direction Q so that the holding apparatus 360 is laid down, relatively small tableware may be stored on the upper side of the basket 330.

The second holding apparatus 370*a* may include the second base bar 371 extending in the front-rear direction, and the second support bar 372 extending upwards from the second base bar 371.

The basket 330 may include a plurality of third protrusion parts 336 protruding upwards from the wire 332. The second base bar 371 may be rotated inside the third protrusion parts 336.

Figure 7:
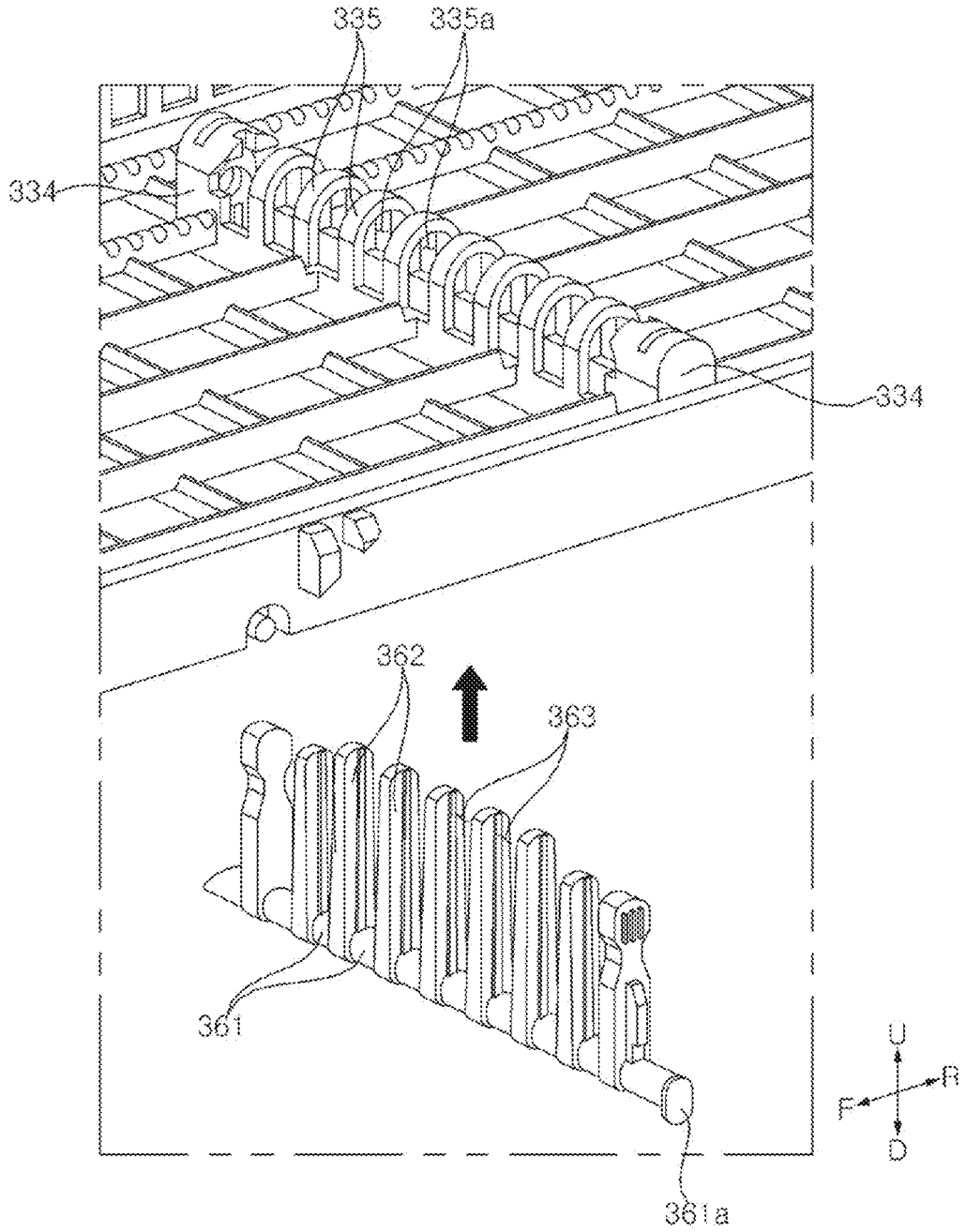
FIG. 7 is a diagram illustrating the assembly of the holding apparatus according to an aspect of the present disclosure.
Figure 8:
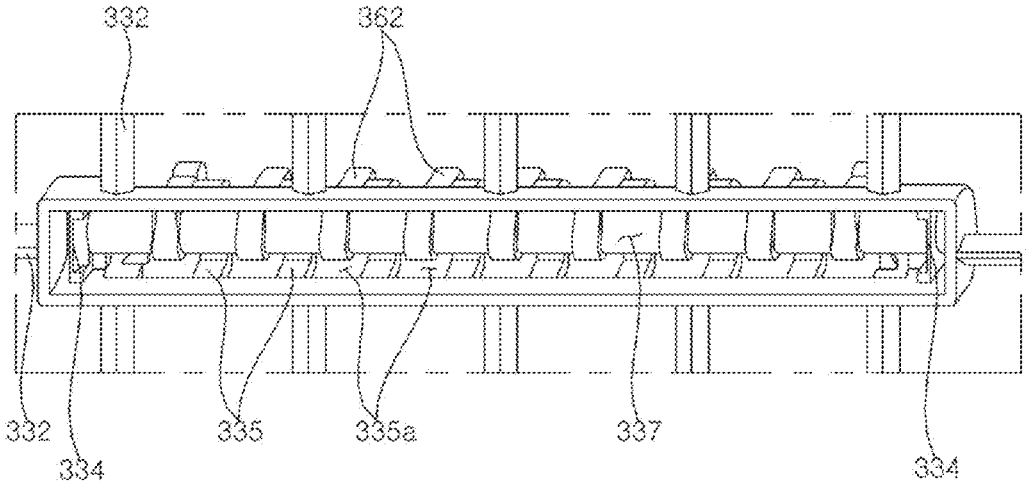
FIG. 8 is a downward perspective view illustrating the holding apparatus according to an aspect of the present disclosure.

Hereinafter, the assembly of the holding apparatus 360 will be described with reference to FIGS. 7 and 8.

The holding apparatus 360 may be inserted upwards into the basket 330. The holding apparatus 360 may be moved upwards from the lower side of the basket 330 to be coupled to the basket 330.

Support-bar insertion holes 335*a* may be formed between the plurality of second protrusion parts 335. The support-bar insertion holes 335*a* may be provided to correspond to the plurality of support bars 362.

When the holding apparatus 360 is moved upwards, the base bar 361 may be located between the pair of first protrusion parts 334. If the holding apparatus 360 is moved upwards, the plurality of support bars 362 may extend upwards through the plurality of support-bar insertion holes 335*a*, respectively.

The base bar 361 may include a hook 361*a* protruding downwards from one end of the base bar 361. The hook 361*a* may be locked in a groove (not shown) formed inside the first protrusion part 334. The hook 361*a* may be disposed to be rotatable at a predetermined angle within the groove (not shown).

The basket 330 may be provided with an apparatus insert part 337 that is open downwards to allow the holding apparatus 360 to be inserted. The wires 332 of the basket 330 may be in a mesh shape, and a portion of the plurality of wires 332 may be cut. The apparatus insert part 337 may be formed in the cut portion of the plurality of wires 332. The apparatus insert part 337 may extend along the extending direction of the base bar 361. The apparatus insert part 337 may extend between the pair of first protrusion parts 334.

Figure 9:
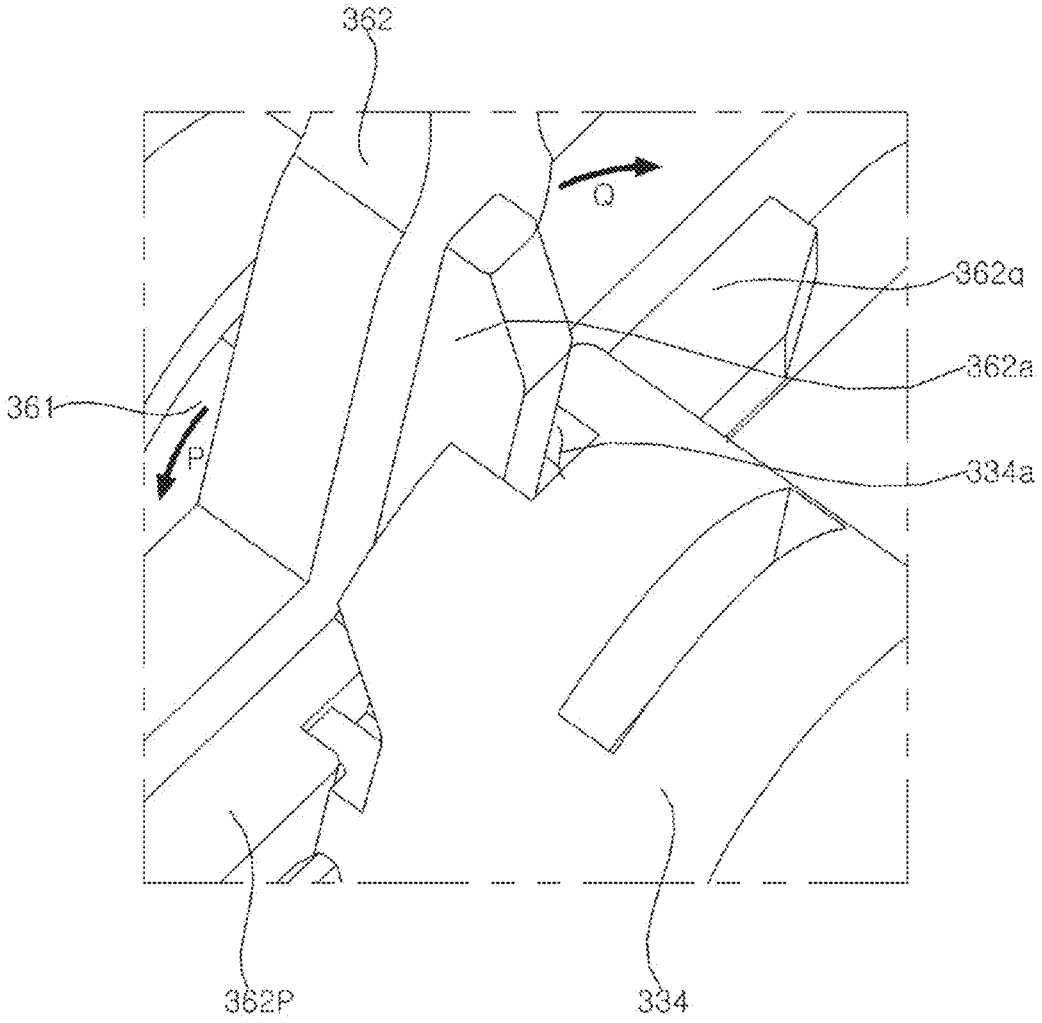
FIG. 9 is an enlarged view illustrating a portion of the holding apparatus according to an aspect of the present disclosure.

Hereinafter, the detaching structure of the holding apparatus 360 will be described with reference to FIG. 9.

The support bar 362 may include a fixing projection 362*a* projecting in the extending direction of the base bar 361. The fixing projection 362*a* may project toward the first protrusion part 334.

The fixing projection 362*a* may be formed on the support bar 362 disposed closest to the first protrusion part 334 among the plurality of support bars 362. The support bar 362 facing the first protrusion part 334 among the plurality of support bars 362 may be provided with the fixing projection 362*a*.

The first protrusion part 334 may include a holder 334*a* into which the fixing projection 362*a* is inserted.

The holder 334*a* may be recessed in a direction away from the base bar 361. The fixing projection 362*a* may project toward the holder 334*a*.

The holder 334*a* may be opened in the vertical direction. The fixing projection 362*a* may be moved upwards from the lower side of the basket 330 to be inserted into the holder 334*a*.

The holding apparatus 360 may be rotated in the first direction P or the second direction Q. When the holding apparatus 360 is rotated, the fixing projection 362*a* may be withdrawn from the holder 334*a*. A user may press the upper portion of the support bar 362 on which the fixing projection 362*a* is formed in a direction away from the holder 334*a* to remove the fixing projection 362*a* from the holder 334*a*.

In a state where the fixing projection 362*a* is withdrawn from the holder 334*a*, a user may rotate the holding apparatus 360 in the first direction P to lay down the holding apparatus 360 in a first state 362*p*.

In a state where the fixing projection 362*a* is withdrawn from the holder 334*a*, a user may rotate the holding apparatus 360 in the second direction Q to lay down the holding apparatus 360 in a second state 362*q*.

Hereinafter, a relationship between the rack 300 and the tub 100 will be described with reference to FIG. 10.

Figure 10:
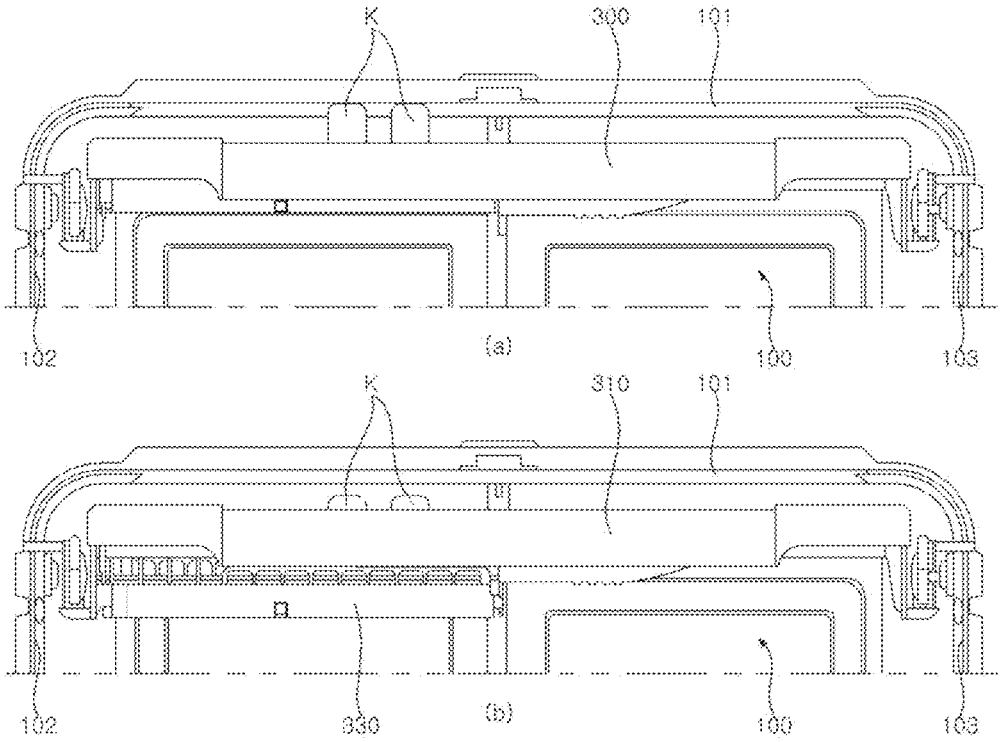
FIG. 10 is an enlarged view illustrating an upper portion of a tub according to an aspect of the present disclosure.

FIG. 10(*a*) is a diagram shown the basket 330 in a raised state, and FIG. 10(*b*) is a diagram showing the basket 330 in a lowered state.

The tub 100 may include an upper wall 101, a first sidewall 102 extending downwards rom the upper wall 101, and a second sidewall 103 extending downwards from the upper wall 101 and facing the first sidewall 102.

The rack 300 may be disposed between the first sidewall 102 and the second sidewall 103. The rack 300 may be disposed under the upper wall 101. The rack 300 may be located at an upper position inside the tub 100.

The knife K may be stored in an upright position on the rack 300 so as to evenly wash both sides of the knife blade. At this time, when the knife K is stored in the second holding apparatus 370*a* or the third holding apparatuses 370*b* and 370*c*, the first sidewall 102 or the second sidewall 103 may interfere with the knife K. Thus, the dishwasher of the present disclosure can prevent interference between the knife K and the tub 100 by storing the knife K in the first holding apparatus 360.

In the dishwasher of the present disclosure, when the knife K is stored in the upright position, the knife K is stored with the basket 330 lowered, thereby preventing interference between the handle of the knife K and the upper wall 101 of the tub 100.

Although the present disclosure was provided above in relation to specific embodiments shown in the drawings, it is apparent to those skilled in the art that the present disclosure may be changed and modified in various ways without departing from the scope of the present disclosure, which is described in the following claims.

The present disclosure may be modified and implemented in various forms, and the scope thereof is not limited to the above-described embodiments. Therefore, if a modification includes components of the claims of the present disclosure, it should be regarded as falling within the scope of the present disclosure.

Any or other embodiments of the present disclosure described above are not exclusive or distinct from each other. In certain or other embodiments of the present disclosure described above, each configuration or function may be used in combination or combined.

For example, this means that configuration A described in a particular embodiment and/or drawing may be combined with configuration B described in other embodiments and/or drawings. That is, even if combination between components is not directly described, it means that combination is possible except for a case where it is described that combination is impossible.

The above detailed description should not be construed as restrictive in any respect and should be considered illustrative. The scope of the present disclosure should be determined by reasonable interpretation of the appended claims, and all changes within the equivalent scope of the present disclosure are embraced in the scope of the present disclosure.

What is claimed is:

1. A dishwasher comprising:

a cabinet in which an opening is formed;

a tub disposed inside the cabinet; and a rack disposed to be withdrawable through the opening from an inside of the tub, wherein the rack comprises:

a basket in which an object to be washed is seated; and a holding apparatus disposed on an upper side of the basket, wherein the holding apparatus comprises:

a base bar connected to the basket;

a plurality of support bars extending upward from the base bar and spaced apart from each other along an extending direction of the base bar; and a gap formed between adjacent support bars of the plurality of support bars, wherein the basket comprises:

a plurality of wires coupled to the holding apparatus;

a pair of first protrusion parts protruding upwards from the wires, and spaced apart from each other in the extending direction of the base bar; and a plurality of second protrusion parts disposed between the pair of first protrusion parts, and spaced apart from each other in the extending direction of the base bar, wherein the base bar is rotatably disposed between the pair of first protrusion parts, wherein a support bar of the plurality of support bars comprises a fixing projection projecting in the extending direction of the base bar, wherein at least one of the first protrusion parts of the pair of first protrusion parts comprises a holder which is recessed in the extending direction of the base bar and into which the fixing projection is inserted, and wherein when the plurality of support bars is in an upright state, the gap is open in a front-rear direction and configured to receive the object, the adjacent support bars being configured to support the object received in the gap.

2. The dishwasher of claim 1, wherein a plurality of holding apparatuses are arranged in a direction intersecting the extending direction of the base bar.

3. The dishwasher of claim 2, wherein the plurality of holding apparatuses are aligned so that each holding apparatus corresponds to the gap.

4. The dishwasher of claim 1, wherein the rack comprises:

a second holding apparatus disposed above the basket and extending in a direction intersecting the base bar;

a fixed storage part spaced apart from the basket; and a partition wall disposed between the basket and the fixed storage part, and wherein the holding apparatus is disposed between the second holding apparatus and the partition wall.

5. The dishwasher of claim 4, wherein the holding apparatus and the second holding apparatus are located lower than the partition wall.

6. The dishwasher of claim 4, wherein the rack comprises:

a pair of third holding apparatuses disposed above the fixed storage part, extending in a direction intersecting the base bar, and spaced apart from each other in the extending direction of the base bar.

7. The dishwasher of claim 6, wherein a gap between the holding apparatus and the partition wall is smaller than a gap between the pair of third holding apparatuses and the partition wall.

8. The dishwasher of claim 1, wherein the basket comprises:

an apparatus insert part formed under the pair of first protrusion parts and the plurality of second protrusion parts, and opened downwards.

9. The dishwasher of claim 1, wherein the tub comprises an upper wall provided above the rack to be spaced apart therefrom, wherein the holding apparatus supports a knife having a knife blade located in the gap, and wherein the upper wall defines a vertical gap from a handle of the knife held on the holding apparatus.

* * * * *